United States Patent [19]

Yamamura

[11] 4,382,320

[45] May 10, 1983

[54] SEAT BELT BUCKLE

[75] Inventor: Mitsuzi Yamamura, Hamamatsu, Japan

[73] Assignee: Fuji Kiko Kabushiki Kaisha, Tokyo, Japan

[21] Appl. No.: 250,887

[22] Filed: Apr. 3, 1981

[30] Foreign Application Priority Data

Sep. 2, 1980 [JP] Japan ..... 55-124942[U]

[51] Int. Cl.[3] ..... A44B 11/26

[52] U.S. Cl. ..... 24/230 A

[58] Field of Search ..... 24/230 A, 230 AL

[56] References Cited

U.S. PATENT DOCUMENTS 4,195,392 4/1980 Ueda et al. ..... 24/230 A

FOREIGN PATENT DOCUMENTS 50-109037 8/1975 Japan .

*Primary Examiner*—Hugh R. Chamblee

*Attorney, Agent, or Firm*—Lane, Aitken & Kananen

[57] ABSTRACT

A seat belt buckle equipped with means for preventing false locking comprises additionally a slider having a supporting means at its front end, supporting the front portion of a latch member. The slider can be slid in accordance with the insertion of a tongue into the buckle. The ratchet is prevented from rotating by the supporting means until when the tongue is completely inserted to its locking position, whereby the tongue is prevented from false locking.

3 Claims, 7 Drawing Figures

SEAT BELT BUCKLE

BACKGROUND OF THE INVENTION

1. Field of The Invention

The present invention relates generally to an improvement on the buckle used on the seat belts in an automotive vehicle or the like, and more particularly to a buckle for a seat belt in which a false locking prevention system is provided in order to lock the seat belt completely.

2. Description of The Prior Art

As is well known, there are various structures of the seat belt buckle fixing one end of the seat belt. A typical conventional structure of seat-belt buckle is disclosed in Tokkai-Sho No. 50-109037 (Japanese Patent Application Open to Public Inspection No. 109037/1975). In such a conventional buckle, a tongue connected to one end of the seat belt is locked by a latch. Since the latch is always urged upwards by a latch spring, when the tongue is not completely inserted or is slowly inserted into the buckle, it is also urged upwards by the latch spring so that it may be not completely engaged with the latch but may be held tightly between the upper surface of the latch and the inner surface of the buckle casing. Thus, the seat-belt user is apt to assume that this unlocked condition is the perfectly locked state; that is, this condition is often called "false locking". When the vehicle is suddenly decelerated in an emergency such as a collision, the tongue easily slips out of the buckle if the user has not been aware of "false locking". Accordingly, such false locking state not only reduces the effect of a seat belt in an emergency, but can also cause serious accidents.

In the prior art, the conventional buckle is further provided with an electrical circuit indicating that the buckle is locked. However, it requires some variety of display device, thereby increasing the cost of the buckle.

SUMMARY OF THE INVENTION

With these problems in mind therefore, it is an object of the present invention to provide a seat belt buckle which can completely lock the seat belt without false locking.

To achieve the above mentioned object, the seat belt buckle of the present invention is equipped with means for preventing false locking which comprises a slider provided within the buckle base so that the sliding member slides in accordance with the insertion or extraction of a tongue, and a supporting member integrally formed on or attached to the slider preventing a latch from moving toward its engagement with the tongue until the tongue is completely inserted to its locking position.

BRIEF DESCRIPTION OF THE DRAWINGS

The features and advantages of a seat belt buckle equipped with a false locking prevention system according to the present invention will be more clearly appreciated from the following description taken in conjunction with the accompanying drawings in which like reference numerals designate corresponding elements and in which:

FIG. 3(*b*) is a sectional side view of the embodiment of FIG. 2 showing the locked state when the tongue is completely inserted;

FIG. 5(*b*) is a sectional side view of the embodiment of FIG. 4 showing the locked state when the tongue is completely inserted.

DETAILED DESCRIPTION OF THE PREFERRED EMBODIMENT

Figure 1:
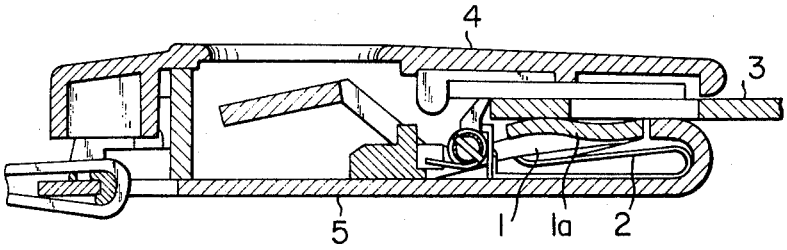
FIG. 1 is a cross sectional view showing a conventional seat belt buckle.

To facilitate understanding of the present invention, a brief reference will be made to a prior art seat belt buckle. Referring to FIG. 1, the reference numeral 1 denotes a latch which is urged upwards by a latch spring 2. The latch 1 and the latch spring 2 are mounted on a buckle base plate 5. A buckle casing 4 provided with openings is secured on the buckle base plate 5. One of openings is used for passing a tongue 3 connected to one end of a safety belt and the other is for a releasing plate 6.

In this prior art buckle, when the tongue 3 is inserted slowly or is not completely inserted to its locking position, the latch spring 2 urges the latch 1 upwards so that the tongue 3 is pressed against the inner surface of the buckle casing 4 by an engagement portion 1*a* of the latch 1. Thus, if the user is not aware of this unlocked condition, the tongue 3 is held between the latch 1 and the inner surface of the buckle casing 4; that is, the buckle is in a "false locking" condition.

Figure 2:
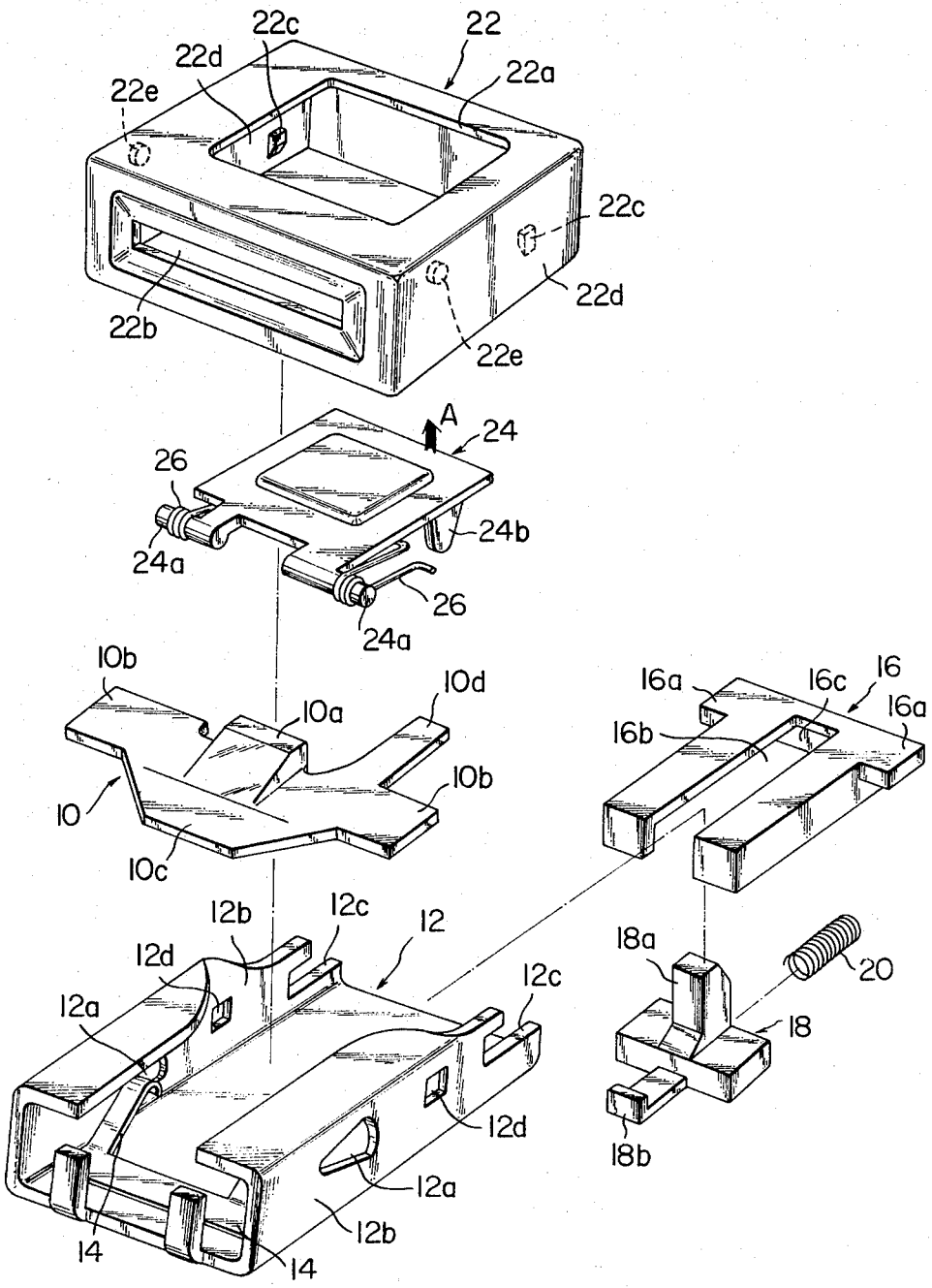
FIG. 2 is an exploded perspective view of a first embodiment of the present invention.

Now, referring to the attached drawings, in FIG. 2, there is shown an exploded perspective view of a seat belt buckle embodied according to the present invention. The reference numeral 10 denotes a latch member which includes an engagement portion 10*a* integrally formed substantially at the center thereof, wing-shaped pivot portions 10*b* at each side, a front trapezoidal portion 10*c* and a rear projecting portion 10*d*. This latch member 10 is pivotably provided within a buckle base 12 by engaging the wing-shaped pivot portions 10*b* with fan shape openings 12*a* formed in the side walls 12*b* of the base 12.

At the region of the front end of the base 12 a plate spring 14 is secured so that the under surfaces of the wing-shaped pivot portions 10*b* are subjected to the force of the plate spring 14. Thus, the latch member 10 is always urged in such a way that the front trapezoidal portion 10*c* is rotated downwards and the rear projecting portion 10*d* is rotated upwards about the pivot portions 10*b*.

The reference numeral 16 denotes a holding member which is secured on the buckle base 12 in such manner that keys 16*a* integrally formed at both sides of the holding member 16 are engaged with slits 12*c* formed at the rear ends of the side walls 12*b*. Further, the holding member 16 is provided with a guide opening 16*b* for guiding a slider 18.

The slider 18 is integrally formed with a projecting head portion 18*a* engaging with the guide opening 16*b* so as to be able to slide along the guide opening 16*b* and an angled plate-shaped projection 18*b*. A coil spring 20 is arranged between the back wall 16*c* of the holding member 16 and the slider 18 so that the slider 18 is always urged forward. Accordingly, the slider 18 is normally located at the front end of the holding member 16 so that the angled plate-shaped projection 18*b* contacts the under surface of the trapezoidal portion 10*c*.

The reference 22 denotes a buckle casing 22 covering the buckle base 12. The buckle casing 22 is provided with a top opening 22*a* through which can be operated a releasing plate 24, a front opening 22*b* through which is passed a tongue, button-like projections 22*c* on both side walls 22*d* fitting into openings 12*d* formed in the side walls 12*b* of the buckle base 12 so that the casing 22 is secured to the base 12, and bearing recesses 22*e* formed in both inner side walls 22*d* supporting the shafts 24*a* of the releasing plate 24 so that the releasing plate 24 is rotatably secured in the buckle casing 22. In addition, the releasing plate 24 is provided with an actuating projection 24*b* on its under surface at the end away from the shafts 24*a* so as to press down the rear projecting portion 10*d* of the latch member 10. The releasing plate 24 is always urged in the direction shown by the arrow A about the shaft 24*a* by means of a coil spring 26.

Figure 3A:
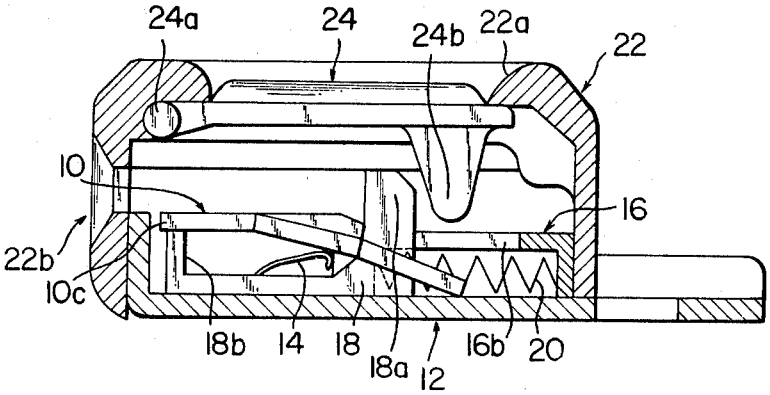
FIG. 3(*a*) is a sectional side view of the embodiment of FIG. 2 showing the case where the tongue has not yet been inserted.
Figure 3B:
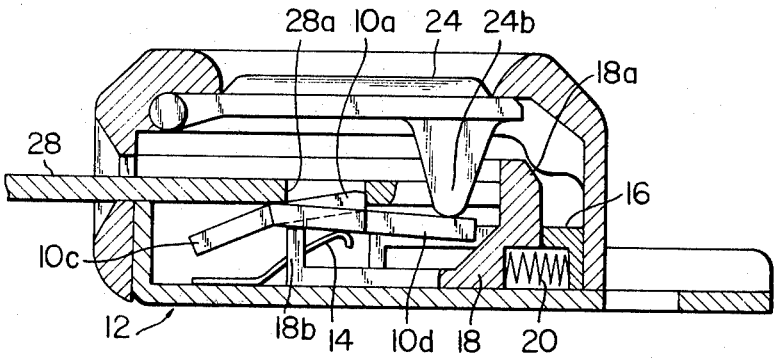

The operation of the seat belt buckle embodied according to the present invention will be considered in detail below. Referring to FIG. 3(*a*), in which is illustrated a sectional side view of the assembled seat belt buckle when the seat belt tongue has never been inserted in the buckle. In this case, the slider 18 is located at its most forward position (the left side in the figure) due to the action of the coil spring 20. The angled plate-shaped projection 18*b* supports the trapezoidal portion 10*c* so that the rear projecting portion 10*d* of the latch member 10 is rotated downwards against the plate spring 14 until the rear end of the rear projecting portion 10*d* contacts to the base 12.

FIG. 3(*b*) shows the case when a tongue 28 is inserted into the interior of the buckle through the front opening 22*b*. The tongue 28 does not interfere with the latch member 10 until it contacts the projecting head portion 18*a*. Then the tongue 28 is further pushed into the buckle so that the slider 18 is moved backwards, towards the right side of the figure thereby compressing the spring 20. The angled plate-shaped projection 18*b* is moved backward supporting the trapezoidal portion 10*c*. Finally, when the tongue 28 is completely inserted to its locking position where it engages with the engagement portion 10*a* of the latch member 10, the projection 18*b* no longer supports the portion 10*c* so that the latch member 10 is subjected to the urging force of the plate spring 14. Accordingly, the latch member 10 is rotated in the counterclockwise direction, in the figure, about the pivot portion 10*b*, thereby engaging an engagement opening 28*a* of the tongue 28 with the engagement portion 10*a* of the latch member 10. Thus the belt tongue 28 is completely locked by the seat belt buckle as shown in FIG. 3(*b*).

In order to release the tongue 28 from its locked state, the user presses down the releasing plate 24 so that the actuating projection 24*b* on the under surface of the releasing plate 24 presses down the rear projecting portion 10*d* of the latch member 10. Thus the latch member 10 is rotated in the clockwise direction, in the figure, so that the engagement portion 10*a* leaves the engagement opening 28*a* of the tongue 28. The tongue 28 is ejected from the buckle by the pushing movement of the projecting head portion 18*a* urged by the restoring force of the coil spring 20.

In the seat belt buckle composed according to the present invention, since the projecting head portion 18*a* of the slider 18 prevents the latch member 10 rotating until the tongue 28 is completely inserted to the position where the tongue 28 can engage with the engagement portion 10*a* of the latch member 10, there is no possibility of false locking occurring.

Figure 4:
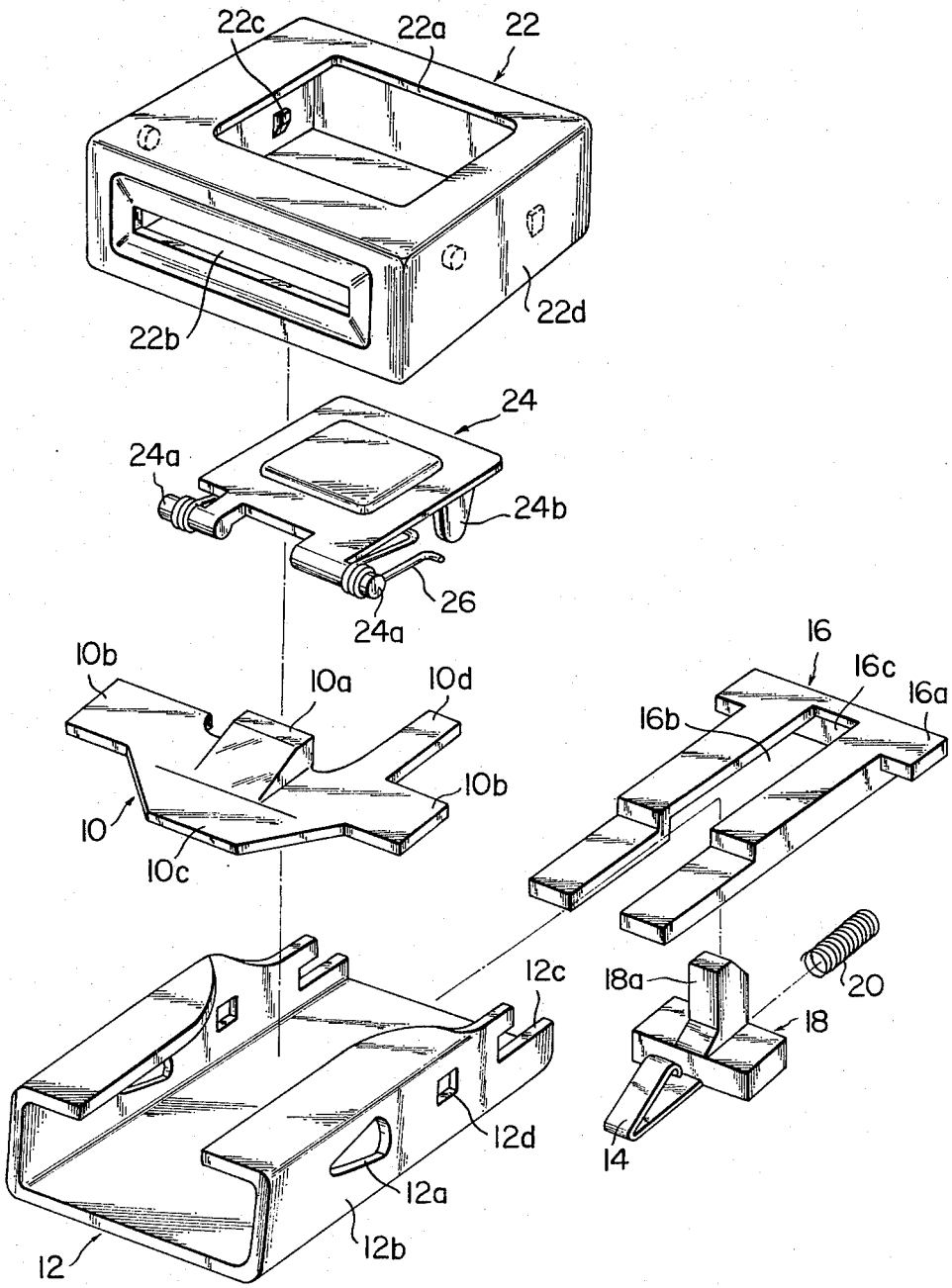
FIG. 4 is an exploded perspective view of a second embodiment of the present invention.

Reference is now made to FIG. 4, in which, is shown a second embodiment according to the present invention. The second embodiment is constructed in substantially same manner as the first embodiment except for the plate spring 14 and the angled plate-shaped projection 18*b*. That is, the plate spring 14 is attached to the front of the slider 18 in place of the angled plate-shaped projection 18*b*.

Figure 5A:
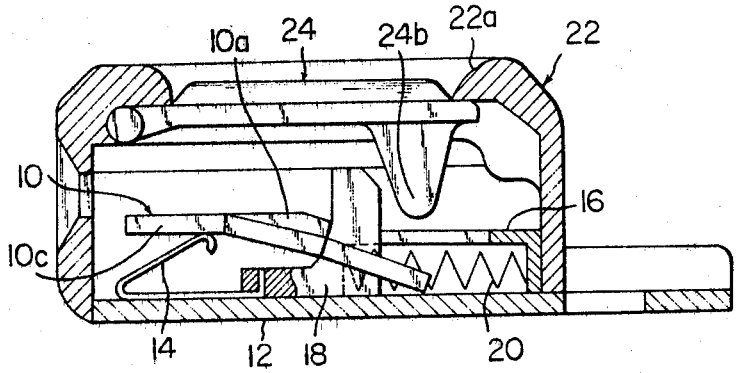
FIG. 5(*a*) is a sectional side view of the embodiment of FIG. 4 showing the case where the tongue has not yet been inserted.
Figure 5B:
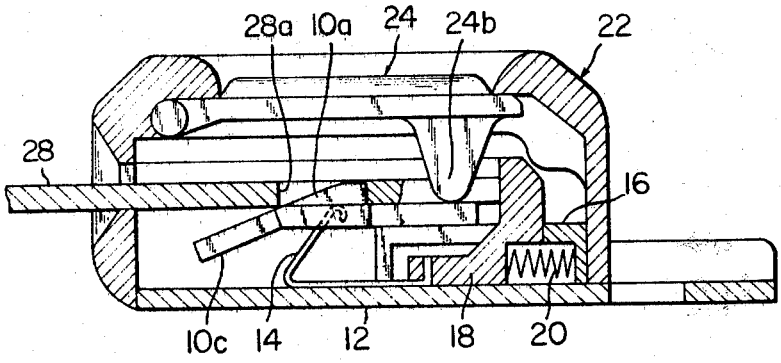

In operation, when the tongue 28 has not yet been inserted in the buckle of the second embodiment, the latch member 10 is not rotated because the plate spring 14 supports the trapezoidal portion 10*c* of the latch member 10 as shown in FIG. 5(*a*). Thus, when the tongue 28 is inserted, the latch member 10 does not push up the tongue 28 until it contacts the projecting head portion 18*a*, thereby preventing the tongue 28 from false locking. Finally, when the tongue 28 is completely inserted, the slider 18 is moved backwards in the same manner as in the first embodiment so that the plate spring 14 pushes up the engagement portion 10*a* of the latch member 10, thereby rotating the latch member 10 to the counterclockwise direction, in the figure, about the pivot portions 10*b*. Thus, the engagement portion 10*a* of the latch member 10 engages with the engagement opening 28*a* of the tongue 28 as shown in FIG. 5(*b*). Accordingly, the tongue 28 can be locked within the seat belt buckle without false locking.

In order to release the tongue 28 from the locked state, the releasing plate 24 is pressed down so that the latch member 10 is rotated so as to disengage the tongue 28 from the latch member 10 in the same manner as in the first embodiment. The plate spring 14 pushes up the trapezoidal portion 10*c* again.

As described hereinabove, according to the present invention, since the seat belt buckle is equipped with a false locking prevention means comprising a slider provided within the buckle base so that the slider slides in accordance with the insertion or the extraction of the tongue, and a supporting member integrally formed on the slider supports the front plate of the latch member so as to prevent the latch member pushing up the tongue until the tongue is completely inserted into the buckle, the tongue is not pushed up by the latch member until it is completely inserted in its locked position so that there is no possibility of false locking occurring. Accordingly, the seat belt tongue is securely locked within the buckle, thereby ensuring the safe operation of the seat belt.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A seat belt buckle comprising:

a base member adapted to connect to one end of a seat belt, having an opening at the front end thereof, for passing a tongue connected to another end of a seat belt therethrough;

a latch member rotatably provided within said base member, said latch member including an engagement portion formed substantially at the center thereof, wing-shaped pivot portions at each side, a front trapezoidal portion, and a rear projecting portion;

a spring member provided between said base member and said latch member so as to urge said latch member upwards;

a casing for covering said base member, formed with a front opening for passing the tongue therethrough and a top opening;

a releasing plate rotatably provided within said casing and always urged by means of a spring, said releasing plate formed with an actuating portion to press down said latch member;

a holding member secured on said base member, said holding member formed with a guide opening; and, a slider integrally formed with a projecting head portion adapted to engage with said guide opening and a supporting means at the front of said slider, said slider being arranged within said holding member and urged forwardly by means of a spring which is disposed between said holding member and the rear surface of said slider so that said slider is normally located at the front end of said holding member and said supporting means contacts the under surface of said trapezoidal portion of said latch member when the tongue is not inserted, thereby preventing said latch member rotating until the tongue is completely inserted.

2. A seat belt buckle according to claim 1, wherein said supporting means is an angled plate-shaped projection.

3. A seat belt buckle according to claim 1, wherein said supporting means is an angled plate spring which serves as said spring member to urge said latch member upwards.

* * * * *